US005538562A

United States Patent [19]

Misaki

[11] Patent Number: 5,538,562

[45] Date of Patent: Jul. 23, 1996

[54] METHOD OF AND AN APPARATUS FOR WASHING COINS

[75] Inventor: Yoshihide Misaki, Amagasaki, Japan

[73] Assignee: Showa Kinzoku Kogyo Co., Ltd., Hyogo, Japan

[21] Appl. No.: 357,719

[22] Filed: Dec. 16, 1994

[30] Foreign Application Priority Data

Jul. 14, 1994 [JP] Japan ..... 6-162284

[51] Int. Cl.[6] ..... B08B 1/02; B08B 9/30

[52] U.S. Cl. ..... 134/6; 134/9; 134/15; 134/25.1; 134/32; 134/42; 134/62; 134/67

[58] Field of Search ..... 134/6, 9, 15, 18, 134/25.1, 25.5, 26, 32, 42, 62, 67, 68; 15/88.3

[56] References Cited

U.S. PATENT DOCUMENTS

| | | | |
|---|---|---|---|
| 2,611,381 | 9/1952 | Davis | 134/67 |
| 2,966,914 | 1/1961 | Sadwith | 134/68 |
| 3,645,199 | 2/1972 | Kanna | 134/68 X |
| 3,938,533 | 2/1976 | Richard | 134/68 X |
| 4,894,095 | 1/1990 | Schramm et al. | 134/25.1 X |
| 5,095,926 | 3/1992 | Wegner | 15/88.3 |
| 5,428,856 | 7/1995 | Thorne | 134/9 |

*Primary Examiner*—Jan H. Silbaugh
*Assistant Examiner*—Saeed Chaudhry
*Attorney, Agent, or Firm*—Schweitzer Cornman & Gross

[57] ABSTRACT

A coin washing method involving introducing coins to be washed into a coin washing apparatus also forming a part of the invention, orienting the introduced coins in the apparatus not to overlap each other, washing one side of the oriented coins, turning the washed coins to expose their unwashed sides, washing the exposed unwashed sides of the coins, removing washing liquid adhered to the washed coins, drying the coins, and discharging the coins from the apparatus, and a coin washing apparatus of a housing having a coin feed opening, and a coin discharge opening a first conveyor belt for receiving and transporting the coins from the feed opening, a positioning roller for orienting the cons on the first conveyor belt not to overlap each other, a first transfer device for transferring the oriented coins from the first conveyor belt, a second conveyor belt for receiving the coins transferred from the first conveyor belt for washing the exposed side of the received coins thereon, a moisture dispenser for spraying a washing liquid onto the second conveyor belt and the coins thereon, a first washing brush for washing with the washing liquid the exposed side of the coins and the second conveyor belt, a third conveyor belt for receiving coins from the second conveyor belt with their unwashed sides exposed, a second washing brush for washing the exposed sides of the coins on the third belt, a dewaterer for removing the washing liquid from the cons as they are being discharged from the third conveyor belt, a heater for drying the substantially dewatered coins, and a second transfer device for transferring the dried coins for their removal from the apparatus through the discharge opening.

19 Claims, 6 Drawing Sheets

METHOD OF AND AN APPARATUS FOR WASHING COINS

FIELD OF THE INVENTION

The present invention relates to a coin washing method and apparatus. As used throughout the specification and claims, the term "coin" includes tokens, gaming chips, and other coinlike objects.

1. Background of the Invention

In one variety of the prior art apparatus for washing coin, the used coins are fed into the machine through a hopper, and the coins are maintained in a single row during the entire process of washing and drying, or at least during the drying after the washing. This requires a considerably long period for the washing and drying of the coins. The maximum processing capacity is about 10,000 to 12,000 coins each hour.

2. Description of the Invention

An object of the present invention is to provide a coin washing method and an apparatus so that the washing capacity is substantially raised above the prior art levels, but still completely washes and dries the coins.

According to the present invention, the coins are washed and dried as they are transported in mass by a plurality of conveyor belts each of a width that is considerably greater than the diameters of the coins. No only does the apparatus have an increased capacity but also both surfaces of each coin are washed and dried in a more reliable manner than in the prior art. The efficiency is raised by the present invention to about 10 times as high as that in case of the prior art, enabling about 120,000 coins to be treated in one hour.

DETAILED DESCRIPTION OF AN EMBODIMENT OF THE INVENTION

Figure 1:
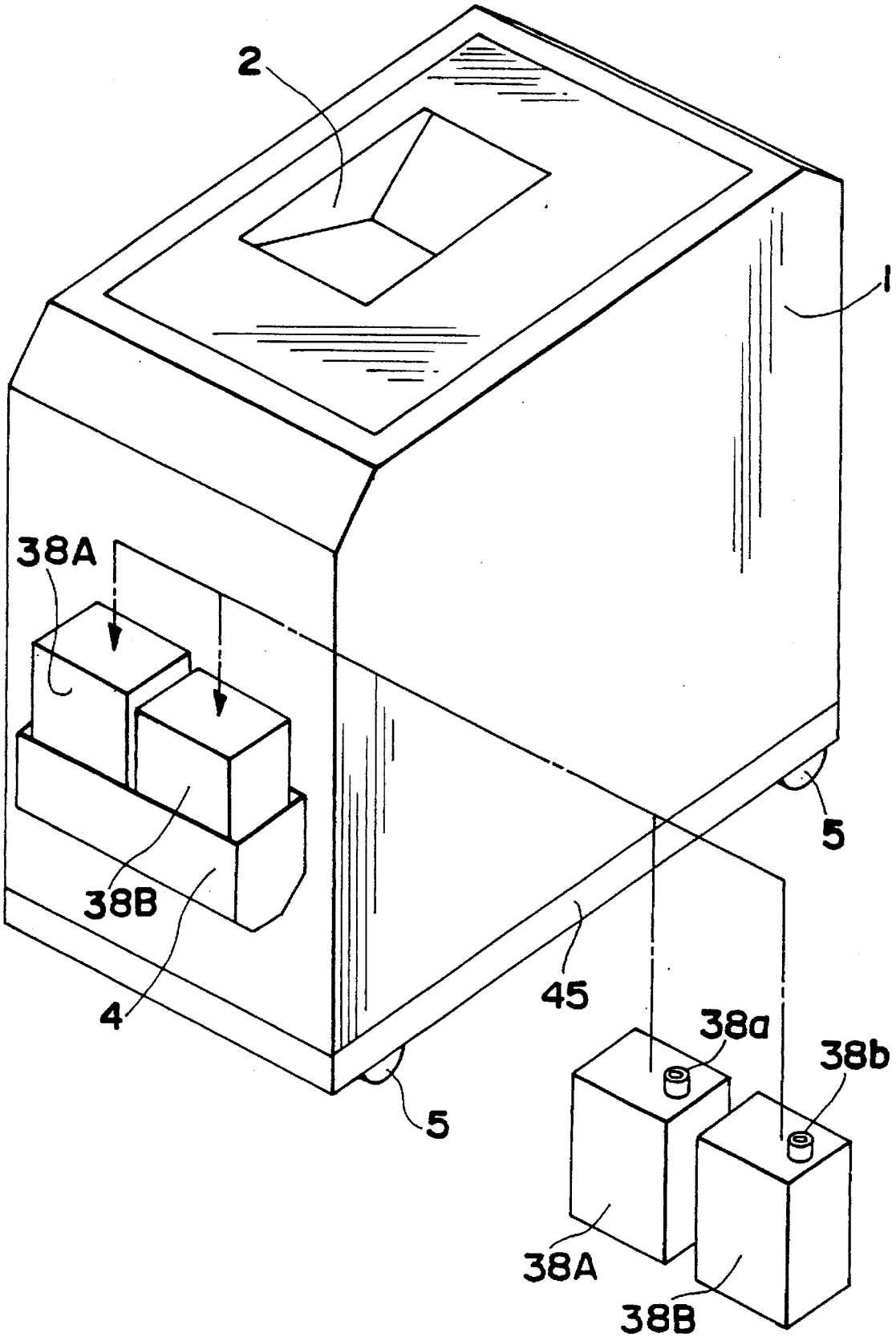
FIG. 1 is a perspective view of one embodiment of the coin washing apparatus of the invention.
Figure 2:
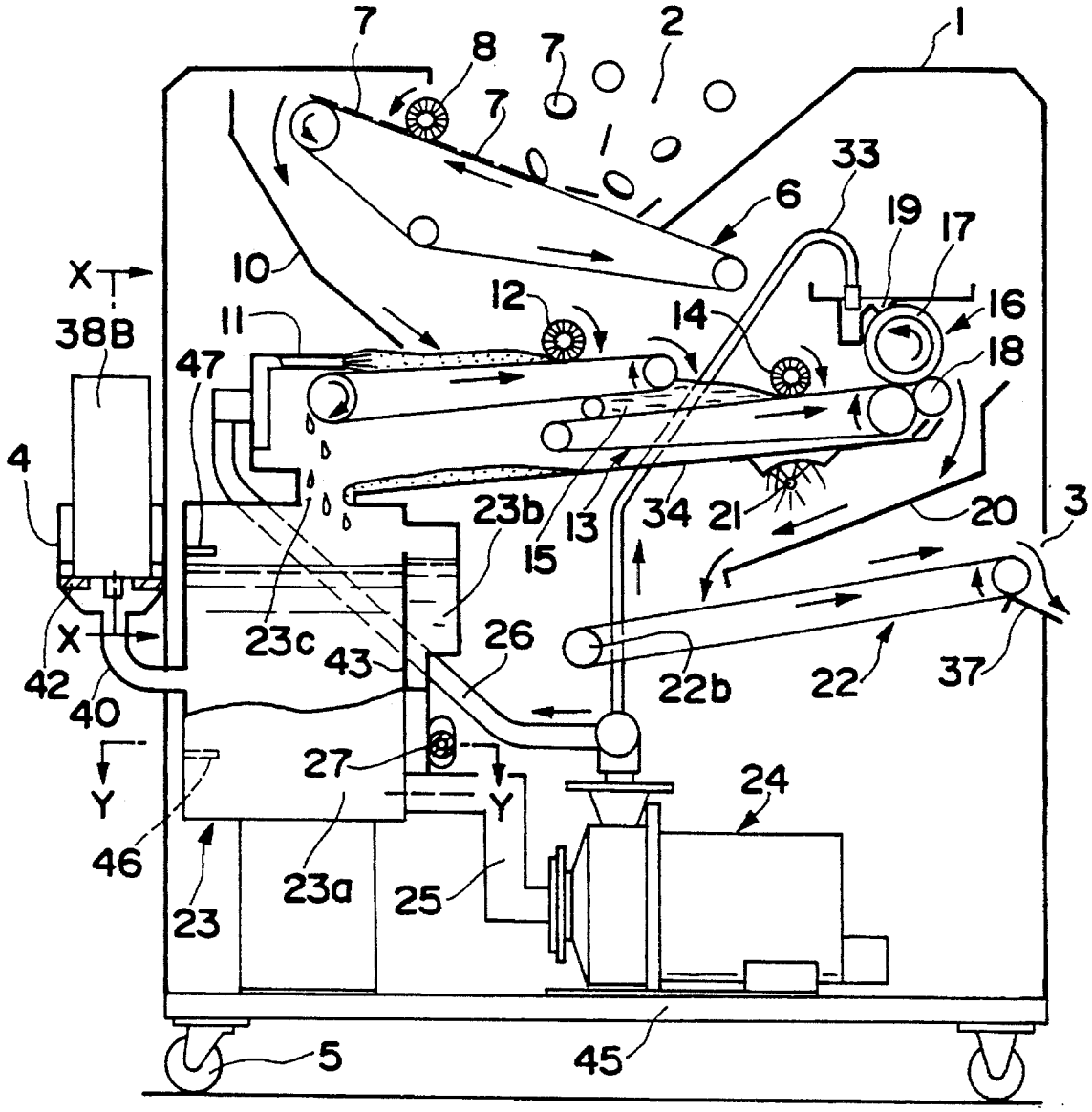
FIG. 2 is a side elevational view of the apparatus of FIG. 1 shown partly in cross section.

As shown in FIGS. 1 and 2 a housing 1 has coin feed opening 2 and a discharge opening 3 provided respectively through a top and a front wall of the housing. An open-top reservoir 4 is attached to a rear wall of the housing for holding upright container of a washing liquid. The bottom of the housing rests on a drain pan 45 with casters 5 secured to its bottom.

Figure 3:
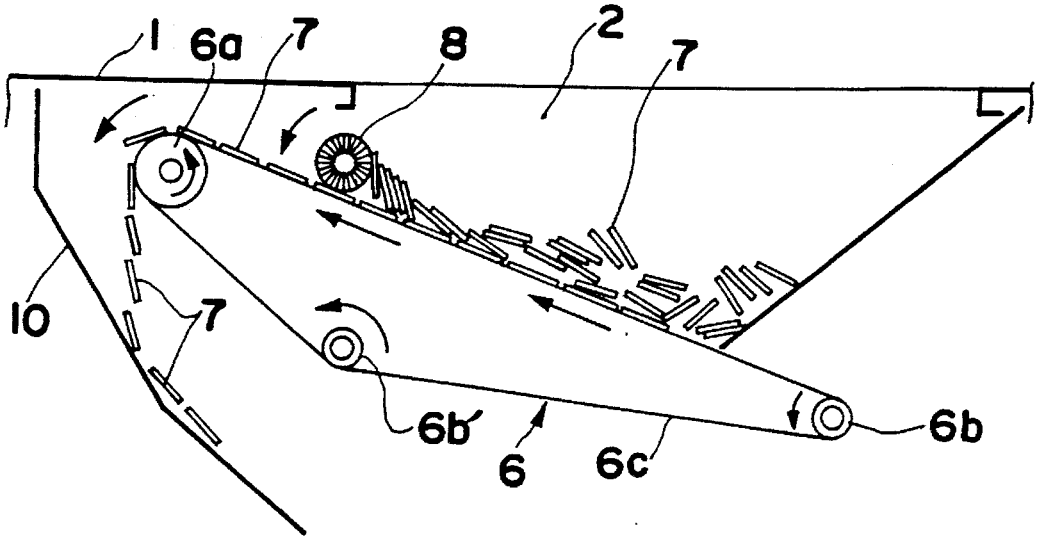
FIG. 3 is an enlarged side elevational view of first belt conveyor of the apparatus of FIG. 1.
Figure 4:
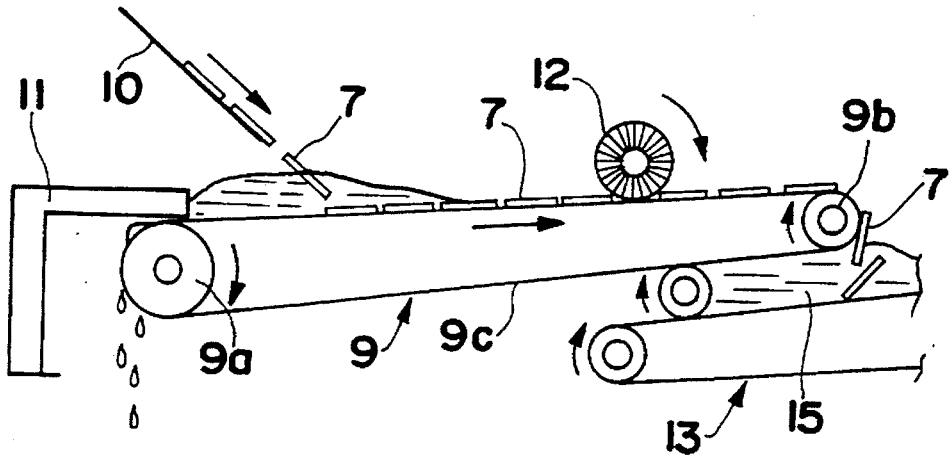
FIG. 4 is an enlarged side elevation of a second belt conveyor of the apparatus of FIG. 1.

As shown in FIG. 3, a first conveyor belt 6 located adjacent to the coin feed opening 2 receives the coins from the feed opening and transports them upwardly at an angle. A positioning roller, suitably a brush 8 prevents the coins 7 from overlaying each other. A second conveyor belt 9 is shown in FIG. 4, and is disposed below the first conveyor belt 6. The second belt 9 receives the coins 7 via a guide plate 10. The second conveyor 9 is also arranged at a slightly oblique angle at a tilt that is opposite to the tilt of the first conveyor. A nozzle 11 supplies washing liquid onto the second conveyor, and a first washing brush 12 washes exposed upper faces of the coins 7 carried by the second conveyor.

Figure 5:
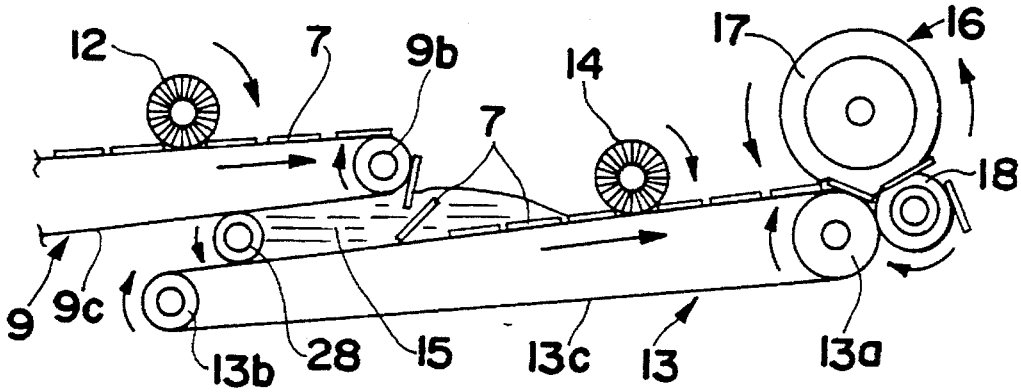
FIG. 5 is a similar enlarged side elevational view of a third belt conveyor and a washing-liquid squeezer of the apparatus of FIG. 1.
Figure 6:
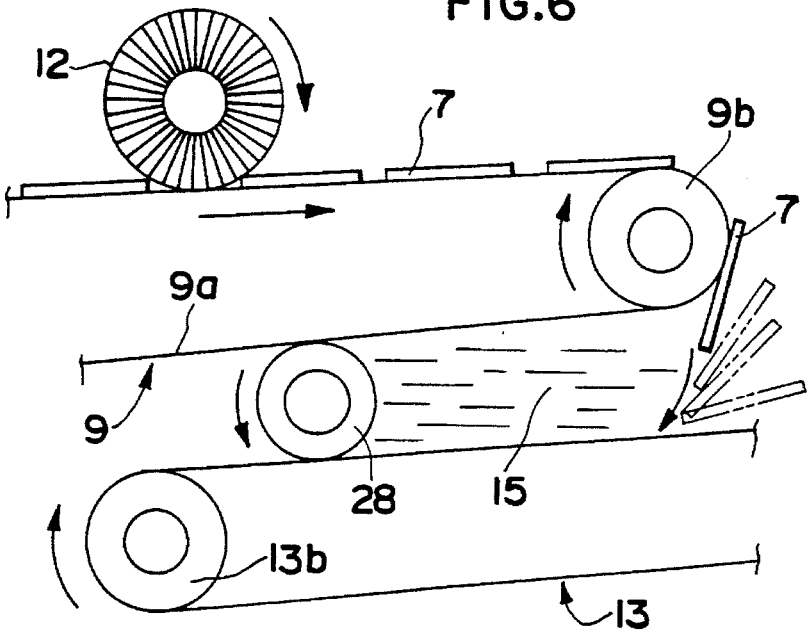
FIG. 6 is an enlarged side elevational view of the second and third belt conveyors of FIGS. 4 and 5.

As shown in FIGS. 4, 5, and 6 a third conveyor belt 13 located below the second conveyor 9 which flips the coins 7 turned upside down onto the third conveyor. That conveyor is also arranged at a slightly oblique angle at a tilt that is in the same direction as the tilt of the second conveyor. A second washing brush 14 washes the exposed faces of the coins 7 as they are carried by the third conveyor. The faces of the coins washed by the second washing brush on the third conveyor are the opposite faces than were washed by the first washing brush 12 on the second conveyor. A hot soaking pool 15 is located between the second and third conveyor belts 9 and 13 to warm the coins as they are transferred to the third conveyor 13.

Figure 7:
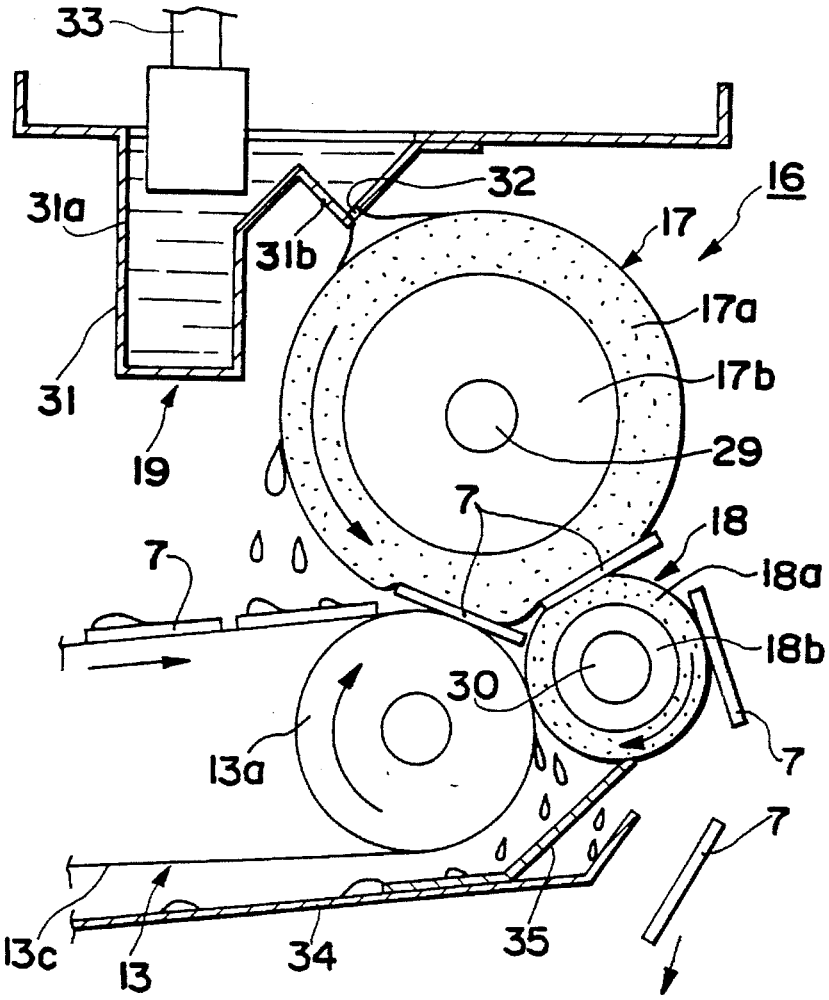
FIG. 7 is an enlarged side elevational view of the washing-liquid squeezer.

As shown best in FIG. 7, a washing-liquid squeezer 16 removes the washing liquid adhering to the coins 7 as they are discharged from the third conveyor 13. The squeezer 16 which has an upper dewatering roller 17 and a lower dewatering roller 18, receives the coins from the upper, the discharging end of the third conveyor. The dewatering rollers are made of a water absorbent elastic material. The squeezer also has a moisture dispenser 19 for wetting the dewatering rollers.

Figure 8:
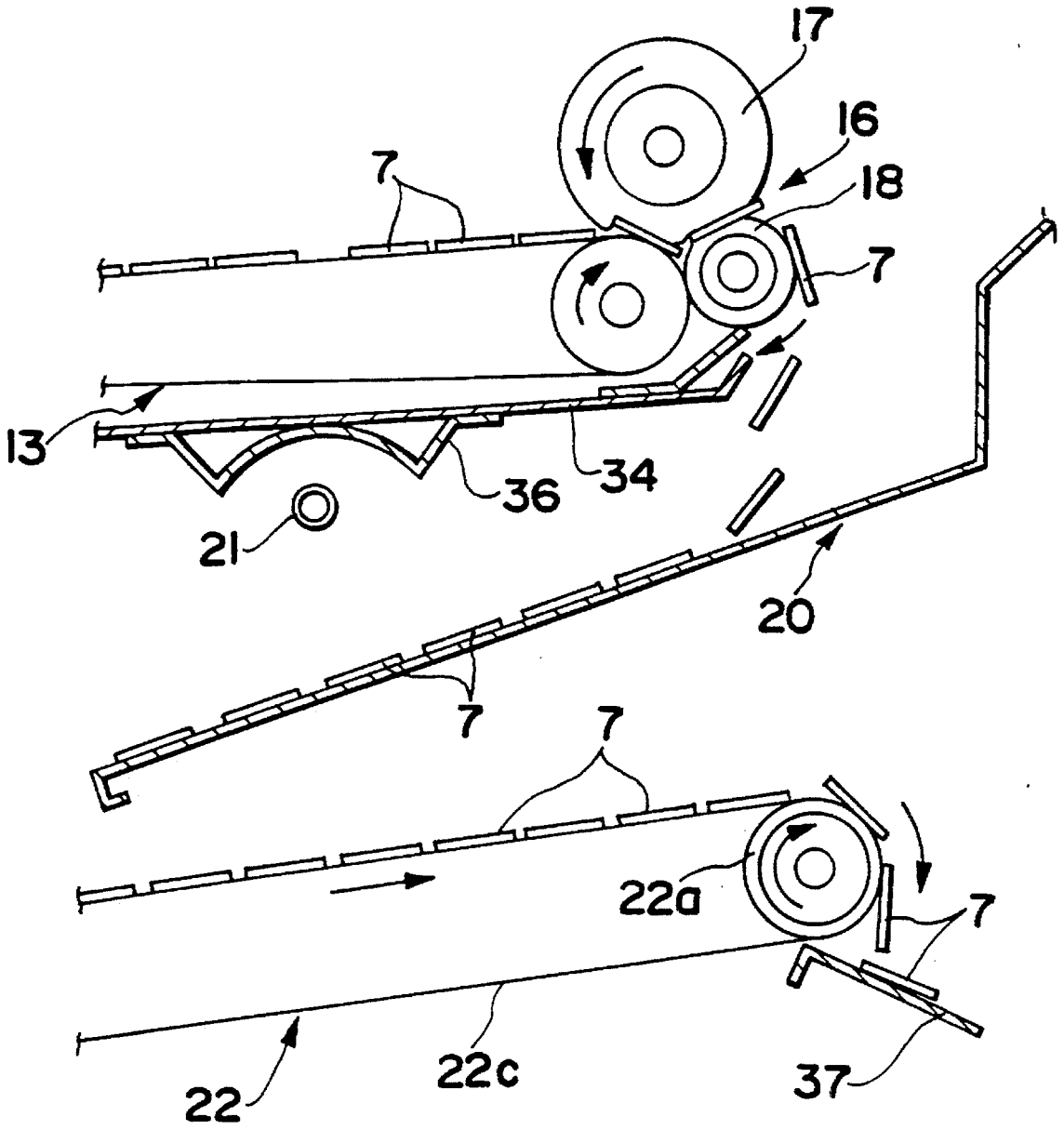
FIG. 8 is an enlarged side elevational view of a drain pan and a fourth belt conveyor.

As shown in FIG. 8, a coin transfer chute 20 receives the dewatered coins and allows them to slide downwardly past a high temperature lamp heater 21 which heats and dries the passing coins. A fourth conveyor belt 22 receives the dried coins from the chute 20 and carries them for discharge outwardly through the discharge opening 3.

As shown in FIG. 2, a pump 24 transports washing liquid from the washing liquid tank 23 to the nozzle 11 through a suction pipe 25. A liquid feeder pipe connects the output of the pump 24 with the nozzle 11. A heater 27 heats the washing liquid contained in the tank 23 to a predetermined temperature.

In carrying out the coin washing method of the present invention the feeding of the coins and initially orienting them into their desired positions into a desirable state are best shown in FIG. 3. The first conveyor belt 6 has a driving roller 6*a* rotating in a direction indicated with an arrow in FIG. 3, an idler roller 6*b*, a tension roller 6*b*' and a belt 6*c* spanned over these roller 6*a*–6*b*'. The width of the first and all subsequent conveyor belts is suitably appreciably greater than the diameter of the coins. The positioning brush 8 rotates in the direction indicated by its adjacent arrow. A number of randomly introduced coins 7 are received on the belt 6*c* from the feed opening 2 the belt moves the coins upwardly to the positioning brush 8. After passing the brush, the individually laid down coins fall from the first conveyor belt 6 onto the guide plate 10 which transfers them onto the second conveyor belt 9.

FIG. 4 shows the washing of one side of the coins 7 that do not overlap each other. The second conveyor 9 has a driving roller 9*a* rotating in the direction indicated with an arrow in FIG. 4, an idler roller 9*b* and a belt 9*c* and circulating around the rollers 9*a* and 9*b*. The belt 9*c* runs faster than the belt 6*c* of the first conveyor. The first washing brush 12 rotates in a direction indicated with an arrow, as the washing liquid is ejected through the nozzle 11 toward the coins advancing on the belt 9*c* , with the nozzle located near the lower end on the top of this belt. Therefore, as the coins 7 slide off the guide plate in succession and fall onto the second belt 9, due to its faster speed the coins will not overlap each other. The upper, exposed faces of the coins wetted with the washing liquid are brushed by the first washing brush 12, before leaving the second conveyor 9 to transfer onto the third conveyor 13 while being turned upside down. A part of the washing liquid ejected through the nozzle 11 onto the second conveyor 12 flows backward and drips off behind the belt and is then recovered and reintroduced into the washing liquid tank 23.

Turning the coins 7 upside down to expose their other sides is shown in FIGS. 5 and 6. The exposed other sides of the coins 7 are subsequently washed and then the washing liquid is removed from the washed coins. FIG. 6 shows in detail the step of turning the coins, wherein the coins 7 are falling off the discharge end of the second conveyor and onto the belt 13*c* of the third conveyor 13, successively turned upside down. The third conveyor 13 has a drive roller 13*a* rotating in the direction indicated with an arrow in FIG. 5, an idler roller 13*b* and a belt 13*c* and circulating around these rollers 13*a* and 13*b*. The belt 13*c* is controller to run substantially the same speed as the belt 9*c* in the second conveyor.

The heater 27 keeps the washing liquid in the tank 23 at a desirably hot temperature. The hot washing water is supplied through the nozzle 11 onto the second conveyor 9. As shown in FIGS. 4 and 5, a part of the supplied hot water moves with the belt 9*c* of the second conveyor. As this hot water flows down over the upper end of second conveyor belt onto the belt 13*c* of the third conveyor, it accumulates on the latter to form the hot soaking pool 15. As shown in FIGS. 5 and 6, the hot soaking pool 15 occupies a space defined between the belt 9*c* of second conveyor and the belt 13*c* of the third conveyor. The lower end of the hot soaking pool is dammed up with an idler roller 28 that is in a rotating contact with both the belts 9*c* and 13*c*.

As coins 7 are transferred from the second conveyor onto the belt 13*c* of third conveyor and are flipped over in the process, they are temporarily immersed into the hot soaking pool 15. As the warmed coins advance towards the discharge end of third conveyor 13, the second washing brush 14 rubs their upper faces before they entering the washing liquid squeezer 16 located at the discharge end of the third conveyor.

The heating of the coins 7 within the hot soaking pool 15 facilitates their drying during the subsequent drying step. The washing liquid filling the hot soaking pool need not necessarily be supplied from the tank 23 through the nozzle 11 and the second conveyor, but can be alternatively fed to the tank from any other source (not shown).

FIG. 7 shows an enlarged view of the washing liquid squeezer 16 wherein the upper dewatering roller 17 has a larger diameter than the lower dewatering roller 18. The upper roller 17 is in an indirect rotating contact with the drive roller 13*a* at the discharge end of third conveyor. The belt 13*c* intervenes between the upper dewatering roller 17 and the drive roller 13*a*, both rotating in opposed directions as shown by the arrows in FIG. 7. The lower dewatering roller 18 is positioned close to but not in contact with, the drive roller 13*a*, and the lower roller is in contact with the upper roller 17 and is driven thereby. Instead of their frictional driving engagement, an independent drive mechanism can also be employed to positively drive the lower roller 18 at the same peripheral speed as the upper one 17. Optional additional pairs of upper and lower dewatering rollers 17 and 18 can be provided, if necessary.

The dewatering rollers 17 and 18 have rigid cores 17*b* and 18*b* and absorbent thick outer layers 17*a* and 18*a*. The cores are attached to shafts 29 and 30, and the outer layers are disposed coaxially with and covering the cores, and are of an absorbent and elastic material such as a sponge, suitably a polyvinyl acetate sponge.

As shown in FIG. 7, the moisture dispenser 19 for wetting the dewatering rollers 17 and 18 includes a water tank 31 and a dispensing nozzle 32 which ejects the water from the tank onto the periphery of the upper roller 17. The washing liquid in the aforementioned tank 23 is received via the pump 24 and is passed through a feed pipe 33 into the water tank 31. One end of the feed pipe 33 is immersed into the washing liquid in tank 31, which is composed of a larger compartment 31*a* and a smaller one 31*b*. The nozzle 32 is formed through a bottom of the smaller compartment 31*b*, into which the washing liquid overflows from the larger compartment 31*a*.

The water ejected from the nozzle 32 of the moisture dispenser 19 is absorbed in the outer layer 17*a* of the upper dewatering roller 17, and an excess of the water flows along the periphery the upper roller onto the lower dewatering roller 18. The reason for positively wetting the rollers 17 and 18 is that their absorbent outer sponge layers 17*a* and 18*a* would be less absorbent unless previously wetted to an appropriate extent. If the atmosphere inside the housing is very cold and dry due to weather or the specific location of the device, the outer layers of the roller will not readily absorb a sufficient amount of water. Thus the prewetting of the roller makes them more absorbent.

At the step of removing the washing liquid shown in FIG. 7, the coins already had both sides washed and as they leave the third conveyor 13, are drawn between the upper dewatering roller 17 and the belt 13*c* rotating around the drive roller 13*a*. The water adhering to the upper side of each coin sandwiched between the rollers is absorbed by the outer layer 17*a* of the upper dewatering roller 17. Subsequently, each coin is pressed between the upper and lower dewatering rollers 17 and 18, whereby the upper side of each coin is further dewatered as the lower side of each coin is also dewatered. During this process, the portions of the rollers that contact the coins and absorb the water therefrom, become moderately compressed to squeeze the water out from their peripheries. The water thus squeezed out from the dewatering rollers 17 and 18 continuously drips and drains off. The dewatered coins 7 then leave the rollers and drop onto the transfer chute 20 located below the third conveyor 13.

As shown in FIGS. 2 and 7, a drain pan 34 is disposed below the third conveyor 13. This drain pan extends below the third conveyor from the washing-liquid squeezer 16 to the washing liquid tank 23, along a descending slope. A doctor blade 35 has an upper edge in contact with a lower peripheral surface of the rotating lower dewatering roller 18. The washing liquid, the water temporarily absorbed in the outer layer 17*a* and 18*a* of the dewatering rollers 17 and 18, as well as any excess of washing liquid fed through the nozzle 32 and falling past the rollers 17 and 18, continuously drips into the drain pan 34. The water removed by the doctor blade 35 also flow into the drain pan. The water or other washing liquid received in the drain pan 34 flows downwardly and is recovered in the washing liquid tank 23, through its opening 23*c*.

FIG. 8 illustrates the step of drying and discharging the coins. The coins 7 dewatered by the squeezer 16 and fallen onto the transfer chute 20 below the third conveyor, move downwardly along this chute while being dried by the high temperature lamp heater 21. A heat reflector 36 reorients the backward radiation from the lamp heater toward the coins. The dried coins 7 are collected on the fourth conveyor 22 beneath the transfer chute 20, and are delivered to a discharge chute 37 leading to the discharge opening 3. The fourth belt conveyor 22 has a drive roller 22*a* rotating in a direction indicated with an arrow, an idler roller 22*b* (FIG. 2) and a belt 22*c* circulating over the rollers 22*a* and 22*b*.

All the belt conveyors 6, 9, 13, and 22 are inclined so that the coins 7 ascend on each of them gently, without slippage and without a change of orientation while being transported. In the case of an excessive slanting of the belts the relative positions of the coins cannot be maintained without slippage.

In the coin washing apparatus of the present invention, both sides of each of numerous coins 7 transported by the belt conveyors 6, 9, 13, and 22 are washed and dried continuously and effectively. The capacity of the apparatus is very high; it can treat about 120,000 coins an hour.

Figure 9:
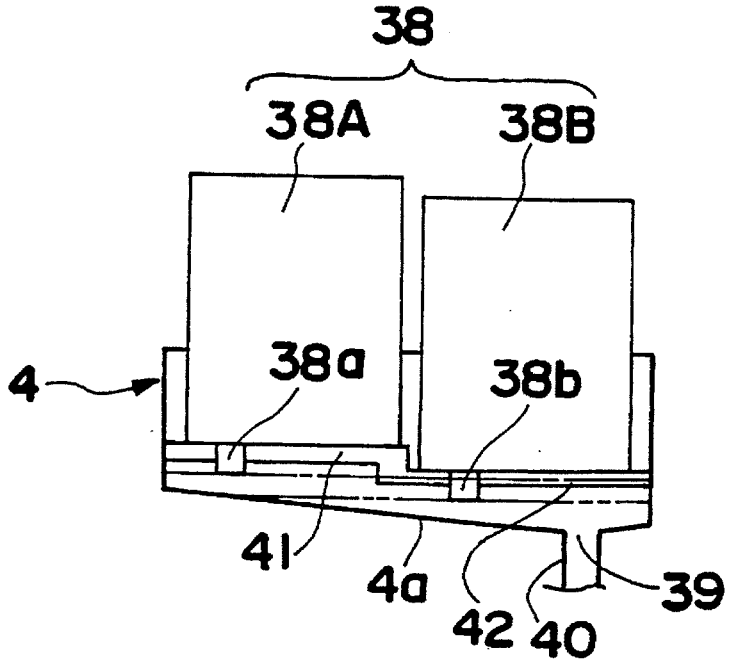
FIG. 9 is a cross sectional view taken along the line X—X in FIG. 2.

As seen in FIGS. 1, 2 and 9, the open-top washing liquid reservoir 4 is in communication with the washing liquid tank 23. Two containers 38A and 38B having respective bottom outlet lugs 38*a* and 38*b* are arranged side by side removably fitting into the open-top reservoir, FIG. 1 shows the containers 38A and 38B in their position turned downside up with their respective outlet lugs 38*a* and 38*b* facing upwardly. An inclined bottom 4*a* of the reservoir 4 has a lowermost exit opening 39 from the bottom. A conduit 40 connected to the liquid exit opening 39 extends into the main tank 23*a* of the washing liquid tank 23. Container support bases 41 and 42 are disposed stepwise in the inclined bottom 4*a* of the reservoir, respectively to support the containers 38A and 38B, one higher than the other.

The containers are filled with the washing liquid, and then the container 38A is placed on the higher base 41 located to the left of the other container 38B which is placed on the lower base 42. Before starting the operation of this apparatus. The rank 23 is filled with washing liquid to a predetermined level. The upper level of the washing liquid on the bottom of reservoir 4 is at the same level in the liquid level tank 23, and both the outlet lugs 38*a* and 38*b* of the containers 38A and 38B are immersed in the washing liquid.

As the water level of the tank 23 becomes lower during the operation of the apparatus, the water level of the open-top reservoir 4 continues to descend until the outlet lug 38*a* of the container 38A on the higher base 41 is above the washing liquid layer in the reservoir. Thereupon the washing liquid contained in the left container 38A is automatically released through the outlet lug 38*a* to replenish the contents of the tank. However in this state, the outlet lug 38*b* of the right container 38B is still in the washing liquid and does not release its contents. When the left container 38A becomes empty and the water level becomes lower than the outlet lug 38*b* of the right container, the latter automatically releases its contents to replenish the tank 23.

The two containers 38A and 38B operate in this manner one after the other to maintain the required water level of the tank, for an extended period. If desired, the apparatus of the present invention can be equipped with three or more such containers.

Figure 10:
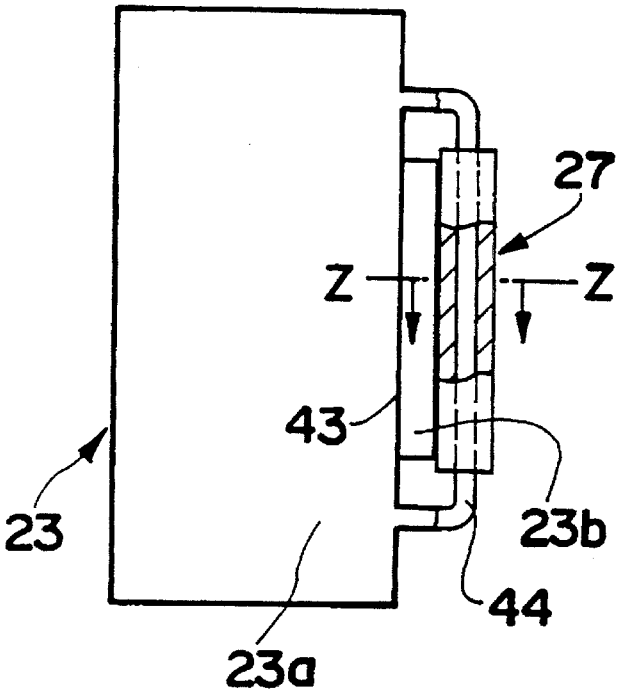
FIG. 10(*b*) is a cross sectional view taken along the line Z—Z in FIG. 10(A).
Figure 10B:
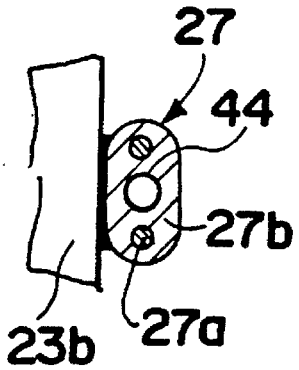
FIG. 10(A) is a cross sectional view taken along the line Y—Y in FIG. 2.

As shown in FIGS. 2 and 10(A), the washing liquid tank 23 also has an auxiliary tank 23*b*. The auxiliary tank 23*b*, which is smaller than the main tank 23*a*, is separated from it by a partition 43. The main tank 23*a*, is connected to the pump 24 by the suction pipe 25. A lower level sensor 46 and a higher level sensor 47 are attached to the main tank. The auxiliary tank 23*b* is connected to a separate water source, such as service pipe (not shown). When the water level descends below the lower sensor 46 and is detected by it, it will generate a signal to cause the water source to start replenishing the contents of the auxiliary tank 23*b* until the so raised level is detected by the upper sensor 47. The heater 27 located outside the auxiliary tank 23*b* heats the washing liquid in the auxiliary tank. As shown in FIG. 10(B), the heater 27 has a block 27*b* of a heat conducting material, and a heating wire 27*b* embedded therein, with the block 27*b* surrounding a circulating pipe 44 in communication with the auxiliary tank 23*b*.

The temperatures of the washing liquid in the main and auxiliary tanks 23*a* and 23*b* in the tank 23 are maintained constant by the heater 27. The delivery of the liquid from the main tank 23*a* takes place through the feed pipes 26 and 33. The washing liquid in the auxiliary tank 23*b* and warmed by the heater 27, is not directly pumped to those pipes. The water level gradually descends as the washing liquid in the main tank 23*a* becomes used up over an extended period and the containers 38A and 38B which have been replenishing the tank become empty. If the operator of the apparatus would not become aware of the exhaustion of the containers and did not refill them with the washing liquid, the lower sensor 46 detects the lower limit of the water level and can initiate its replenishment from the service source. As a result, the water level of the auxiliary tank 23*b* rises until the water overflows therefrom into the main tank 23*a* and when the water level of the main tank reaches the upper limit detected by the upper sensor 47, the further supplying of the water will close. If the auxiliary tank 23*b* is not always filled with the hot water heated by the heater 27, then a cold water will be undesirably supplied to the main tank 23*a* and the feed pipes 26 and 33. However, in the present invention, the hot water in the auxiliary tank 23*b* will warm the fresh and cold water supplied thereto before it is transferred to the main tank 23*a*, thereby avoiding such a problem.

I claim:

1. A coin washing method, comprising steps of:

(i) introducing coins to be washed into a coin washing apparatus, (ii) orienting said coins in the apparatus so that they do not overlap each other, (iii) washing one side of each of said coins, (iv) turning said coins over to expose unwashed sides thereof, (v) washing the unwashed sides of said coins, (vi) substantially removing washing liquid adhered to said coins, (vii) drying the coins, and (viii) discharging the coins from the apparatus.

2. The coin washing method of claim 1, wherein the method is carried out with a washing liquid on a plurality of conveyor belts each of a width larger than said coins, and wherein said substantially removing washing liquid comprises advancing said coins between prewetted absorbent and elastic dewatering rollers.

3. The coin washing method of claim 1, wherein said orienting comprises contacting said coins after introducing into the coin washing apparatus with a positioning brush rotating adjacent to a conveyor belt with said coins thereon.

4. The coin washing method of claim 1, wherein said turning said coins over comprises transferring the coins from a first conveyor belt having an end to a second conveyor belt by flipping the coins over the end of the first conveyor belt onto the second conveyor belt.

5. The coin washing method of claim 4, wherein the second conveyor belt is running faster than the first conveyor belt to maintain said coins in a nonoverlapping position.

6. A coin washing apparatus comprising:

(i) a housing having a coin feed opening, and a coin discharge opening, (ii) a first conveyor belt for receiving and transporting said coins from said feed opening, (iii) a positioning roller for orienting the coins on the first conveyor belts so that they do not overlap each other, (iv) first means for transferring said coins from said first conveyor belt, (v) a second conveyor belt for receiving said coins transferred from said first conveyor belt for the purpose of washing an exposed side of said coins thereon, (vi) moisture dispensing means for dispensing a washing liquid onto said second conveyor belt and said coins thereon, (vii) a first washing brush for washing with the washing liquid the exposed side of said coins on the second conveyor belt, (viii) a third conveyor belt for receiving said coins from the second conveyor belt with unwashed sides exposed, (vix) a second washing brush for washing the unwashed sides of the coins on said third belt, (x) dewatering means for substantially removing the washing liquid from the coins as they are being discharged from said third conveyor belt, (xi) means for heating and drying said coins after substantially removing the washing liquid therefrom, and (xii) second transfer means for transferring said coins from said heating and drying means for their removal from the apparatus through said discharge opening.

7. The coin washing apparatus of claim 6, wherein each of said conveyor belts is inclined for conveying said coins upwardly without slippage of said coins thereon.

8. The coin washing apparatus of claim 6, wherein said dewatering means comprises a pair of liquid squeezer rollers each with an absorbent periphery for squeezing liquid from wet coins passing therebetween.

9. The coin washing apparatus of claim 8, further comprising means for prewetting said liquid squeezer rollers for maintaining absorbency of peripheries thereof.

10. The coin washing apparatus of claim 6, further comprising a fourth conveyor belt for receiving said coins from said second transfer means, and for delivering said coins to said discharge opening.

11. The coin washing apparatus of claim 8, further comprising a washing liquid tank, a pump for conveying washing liquid from the washing liquid tank to said moisture dispensing means.

12. The coin washing apparatus of claim 6, further comprising means for creating a hot soaking pool between said second and third conveyor belts for warming the coins transferred from said second conveyor belt to said third conveyor belt.

13. The coin washing apparatus of claim 11, further comprising a drain pan disposed below said third conveyor belt and extending between said liquid squeezer rollers and said washing liquid tank for receiving into the tank washing liquid removed by said liquid squeezer rollers from said coins.

14. The coin washing apparatus of claim 13, wherein said liquid squeezer rollers comprise an upper and a lower liquid squeezer roller, the apparatus further having a doctor blade in contact with the periphery of the lower liquid squeezer roller for removing surface water therefrom.

15. The coin washing apparatus of claim 9, wherein said means for prewetting said liquid squeezer rollers comprises a prewetting water tank and a prewetting nozzle for ejecting prewetting water onto the periphery of a liquid squeezer roller.

16. The coin washing apparatus of claim 15, further comprising a pump for supplying water to said prewetting water tank.

17. The coin washing apparatus of claim 11, further comprising a reservoir adapted to hold a plurality of containers of washing liquid for replenishing washing liquid in said washing liquid tank, said reservoir having an inclined bottom and a plurality of bases for the containers, the bases being arranged in height stepwise relative to each other for supporting the containers at different heights relative to each other.

18. The coin washing apparatus of claim 11, wherein said washing liquid tank comprises a main tank connected from the pump, an auxiliary tank connected from a water source, a heater for heating washing liquid in the washing liquid tank and the auxiliary tank, a lower water level sensor for detecting a lower water level in the main tank for initiating supplying of sufficient water from the water source to the auxiliary tank for replenishment of the main tank.

19. A coin washing apparatus, comprising (i) means for introducing coins to be washed into the apparatus, (ii) means for orienting said coins in the apparatus so that they do not overlap each other, (iii) means for washing one side of each of said coins after they are oriented, (iv) means for turning said coins over after washing one side thereof to expose unwashed sides thereof, (v) means for washing the unwashed sides of said coins, (vi) means for substantially removing washing liquid adhered to said coins after they are washed, (vii) means for drying said coins, and (viii) means for discharging the coins from the apparatus after drying.

* * * * *